US008281525B2

(12) United States Patent
Driscoll

(10) Patent No.: US 8,281,525 B2
(45) Date of Patent: Oct. 9, 2012

(54) MODULAR SPIRAL STAIRCASE ASSEMBLY

(75) Inventor: Terry L. Driscoll, Rochester, MN (US)

(73) Assignee: Custom Iron, Inc., Zumbrota, MN (US)

( * ) Notice: Subject to any disclaimer, the term of this patent is extended or adjusted under 35 U.S.C. 154(b) by 0 days.

(21) Appl. No.: 12/701,507

(22) Filed: Feb. 5, 2010

(65) Prior Publication Data

US 2011/0192099 A1 Aug. 11, 2011

(51) Int. Cl.
*E04F 11/00* (2006.01)

(52) U.S. Cl. ..... 52/187; 52/174

(58) Field of Classification Search ..... 52/187, 52/174, 182, 183; 256/19, 65.08, 67, 59, 256/60, 47

See application file for complete search history.

(56) References Cited

U.S. PATENT DOCUMENTS

| | | | | |
|---|---|---|---|---|
| 1,031,654 | A * | 7/1912 | Haskell | 411/298 |
| 1,547,254 | A | 7/1925 | McClure | |
| 1,774,582 | A | 9/1930 | Woodbridge | |
| 2,654,579 | A * | 10/1953 | Cremens | 256/21 |
| 2,808,233 | A | 10/1957 | Moritz | |
| 2,820,613 | A | 1/1958 | Schilling | |
| 2,855,227 | A | 10/1958 | Bottom | |
| 2,869,829 | A * | 1/1959 | Spangberg | 256/65.12 |
| 3,343,811 | A | 9/1967 | Kusel | |
| 3,372,909 | A | 3/1968 | Attaway | |
| 3,414,236 | A | 12/1968 | Siegal | |
| 3,991,981 | A | 11/1976 | Wu | |
| 4,050,828 | A | 9/1977 | Noro | |
| 4,132,391 | A | 1/1979 | Takenaga | |
| 4,373,310 | A * | 2/1983 | Dean | 52/182 |
| 4,438,608 | A * | 3/1984 | Hamm | 52/187 |
| 4,508,320 | A * | 4/1985 | Hegarty | 256/47 |
| 5,557,893 | A * | 9/1996 | Bowls | 52/187 |
| 6,752,385 | B2 | 6/2004 | Zen | |
| 7,543,802 | B2 * | 6/2009 | Petta et al. | 256/65.08 |
| 7,614,612 | B2 | 11/2009 | Edwards | |
| 2008/0121857 | A1 | 5/2008 | Lo | |

* cited by examiner

*Primary Examiner* — William Gilbert
*Assistant Examiner* — Gisele Ford
(74) *Attorney, Agent, or Firm* — Fredrikson & Byron, P.A.

(57) ABSTRACT

A modular spiral staircase assembly that involves a handrail formed of one or more sections and a series of slide members each configured to form a link between both a baluster and the handrail of the staircase. The use of such slide members enables initial ease with respect to positioning of the balusters along the extent of the handrail and subsequent secure locking of such balusters in position with respect to the handrail for alignment purposes with corresponding treads of the staircase. Additionally, using such slide members along the extent of the handrail provides the installer ready-made tools for progressively shaping the extent of the handrail so as to align it with the curvature of the staircase.

22 Claims, 5 Drawing Sheets

MODULAR SPIRAL STAIRCASE ASSEMBLY

BACKGROUND

1. Field of the Invention

The present invention relates to spiral staircase and handrail assemblies, and more particularly, to systems and methods used for installing such assemblies.

2. Description of the Related Prior Art

Spiral staircase designs are well known in the art. For safety reasons, virtually all spiral staircase designs include accompanying handrails. While continuous lengths of metal are often preferred for handrails due to aesthetic considerations, it has been found difficult to utilize such because precision support pieces are routinely required for proper alignment of the rail above the treads of the staircase. To that end, a wide variety of devices have been introduced for securing the handrail to the treads of the staircase by balusters or posts, but the majority of these devices are difficult to work with because they require precise forming and positioning of not only the handrail but also of the support and attachment mechanisms for the handrail. The alternative to this can be to form screw bores and the like in the pieces on site when installing the staircase and handrail. However, even in such cases, proper installation and fitting of the handrail can be found to be difficult and time-consuming processes. Furthermore, such attachment mechanisms are often found to be quite complex and expensive.

An additional problem with handrails for spiral staircases of the prior art is that the sides of the rail can be bendable to a fault if too long and quite rigid if too short. As such, when using such extreme lengths, the materials that can be used can be limited. For example, it is not uncommon when attempting to form curvature in a lengthy handrail, so as to align it with a spiral staircase, to end up with one or more undesirable bends over its extent. To address this, in some designs, handrails have been conventionally formed of multiple pieces. However, such designs can still be found to complicate matters as the separate pieces, in light of their shortened length, are more difficult to bend with the requisite curvature.

The present invention solves these and other problems.

SUMMARY OF THE INVENTION

Embodiments of the invention provide a modular spiral staircase assembly that involves a handrail of one or more sections and a series of slide members each configured to form a link between both a baluster and the handrail of the staircase. The use of such slide members enables initial ease with respect to positioning of the balusters along the extent of the handrail and subsequent secure locking of such balusters in position with respect to the handrail for alignment purposes with corresponding treads of the staircase. Additionally, using such slide members along the extent of the handrail provides the installer ready-made tools for progressively shaping the extent of the handrail so as to align it with the curvature of the staircase.

DETAILED DESCRIPTION

Figure 1:
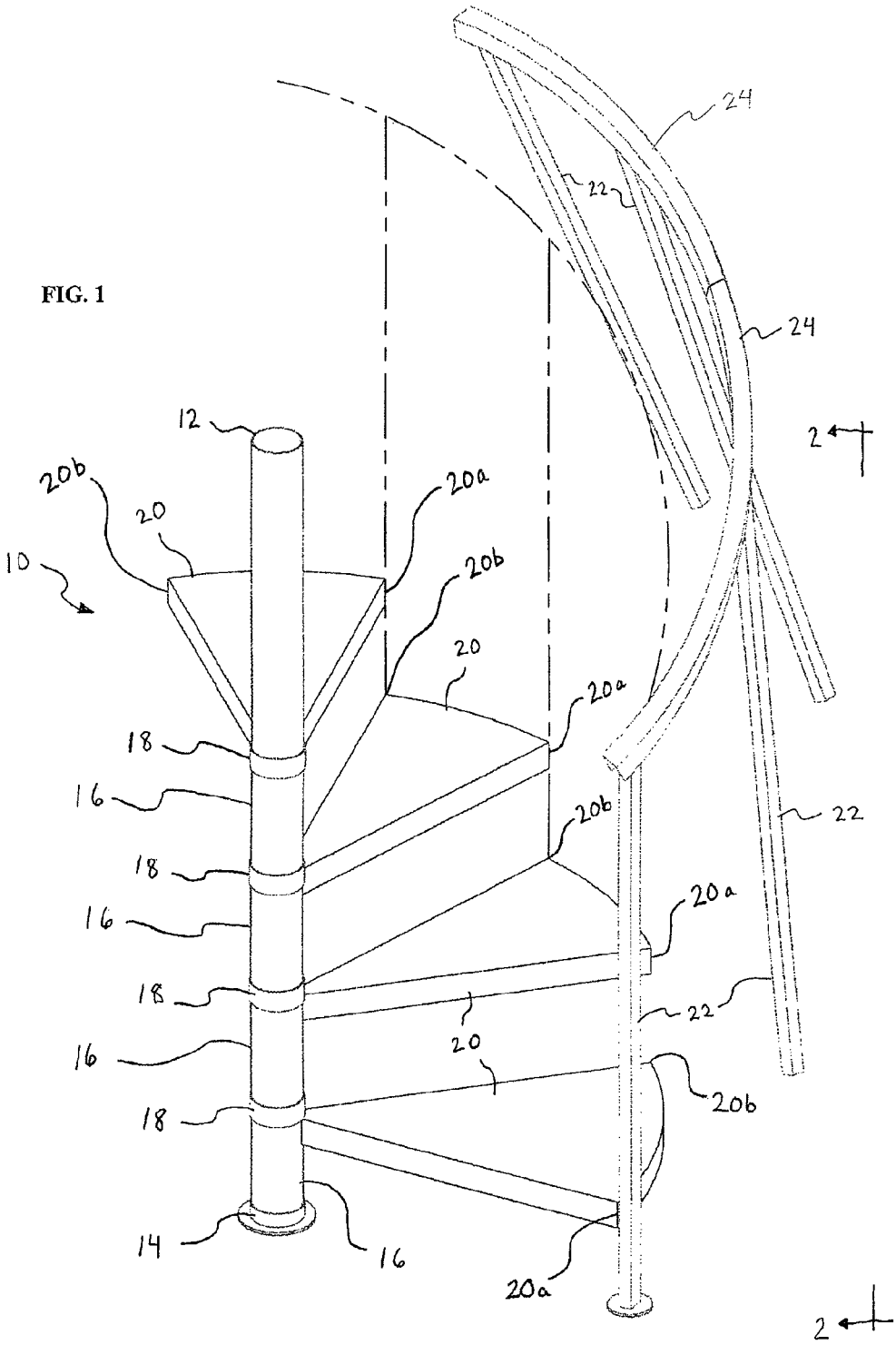
FIG. 1 is a fragmentary perspective front view of a lower portion of a spiral staircase in accordance with certain embodiments of the invention.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, and are not intended to limit the scope of the invention as defined in the claims.

FIG. 1 shows a fragmentary perspective front view of a lower portion of a spiral staircase in accordance with certain embodiments of the invention. The spiral staircase, generally designated as 10, includes a central column 12. As shown, the column 12 can generally include a base member and a spacer 14 thereon. In certain embodiments, as shown, the column 12 further includes a plurality of collars 16 and spacer rings 18 mounted in a vertically stacked relationship, with each collar 16 being positioned between a pair of the spacer rings 18. Each collar 16 mounts a tread 20 to extend radially outwardly there from, with successive treads 20 of the staircase 10 being vertically and angularly offset from each other. As shown, the staircase 10 includes a plurality of balusters 22 operatively linking the treads 20 to a handrail section 24 of the staircase 10.

Figure 2:
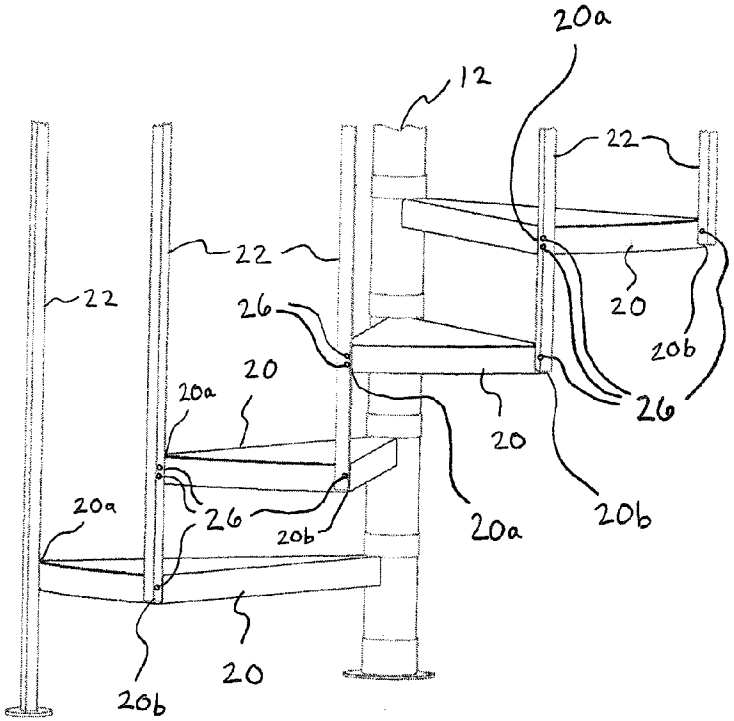
FIG. 2 is a fragmentary side view of the spiral staircase of FIG. 1 that is generally taken along the line and in the direction of the arrows 2-2 of FIG. 1.

To that end, FIG. 2 illustrates a fragmentary side view of the spiral staircase 10 that is generally taken along the line and in the direction of the arrows 2-2 of FIG. 1. As shown, in certain embodiments, a first baluster 22, or lowermost of the balusters, is operatively coupled to a front corner portion 20*a* of a first of the treads 20, while other intermediate balusters 22 are each operatively coupled to a rear portion 20*b* of one of the treads 20 and front portion 20*a* of a next vertically successive tread 20. Connection means between the balusters 22 and the treads 20 are provided via one or more fasteners 26, which in some cases, can be screws or bolts. Therefore, in certain embodiments, as shown in FIG. 2, the fasteners 26 are used for operatively coupling each of the balusters 22 to one or more of the front corner portions 20*a* and the rear corner portions 20*b* of the treads 20. It should be appreciated that the sizes and quantities of the fasteners 26 used for operatively coupling the balusters 22 to the treads 20 can be variably specified.

Figure 3:
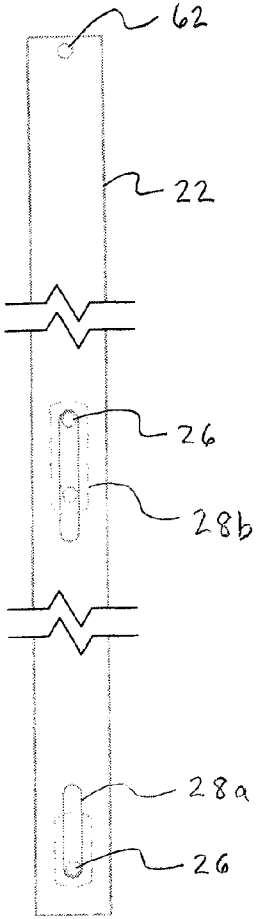
FIG. 3 is a side view of an intermediate baluster of the spiral stairway of FIG. 1 with vertical intermediate parts broken away in accordance with certain embodiments of the invention.

FIG. 3 shows a side view of one of the intermediate balusters 22 of the spiral stairway 10 with vertical intermediate parts broken away in accordance with certain embodiments of the invention. With reference to FIGS. 2 and 3, in certain embodiments, each of the fasteners 26 operatively coupling the intermediate balusters 22 to the front and rear corner portions 20*a*, 20*b* of the corresponding treads 20 are positioned within baluster slots 28*a*, 28*b*, respectively. The slots 28*a*, 28*b* are vertically elongated to permit limited vertical adjustment of the baluster 22 relative to the treads 20 before the fasteners 26 are tightened to retain the baluster 22 in a fixed position relative to the treads 20.

In certain embodiments, the handrail section 24, as shown in FIG. 1, is made up a continuous piece, and as described hereafter, when being installed using the assembly and method of the present invention, is generally curved about the diameter of the outer edges of the treads 20 vertically ascending about the central column 12. As a result, the handrail section 24 is longer in extent than the flat diameter of the treads outer edges as the section 24 is both adaptively curved in the direction of elongation and inclined upwardly to extend angularly, in simple applications, through at least 20 degrees and in more complicated applications, through at least 180 degrees and possibly to extend angularly through substantially more than at least 360 degrees. For convenience, the direction of elongation hereinafter will be referred to as "longitudinal".

Figure 4A:
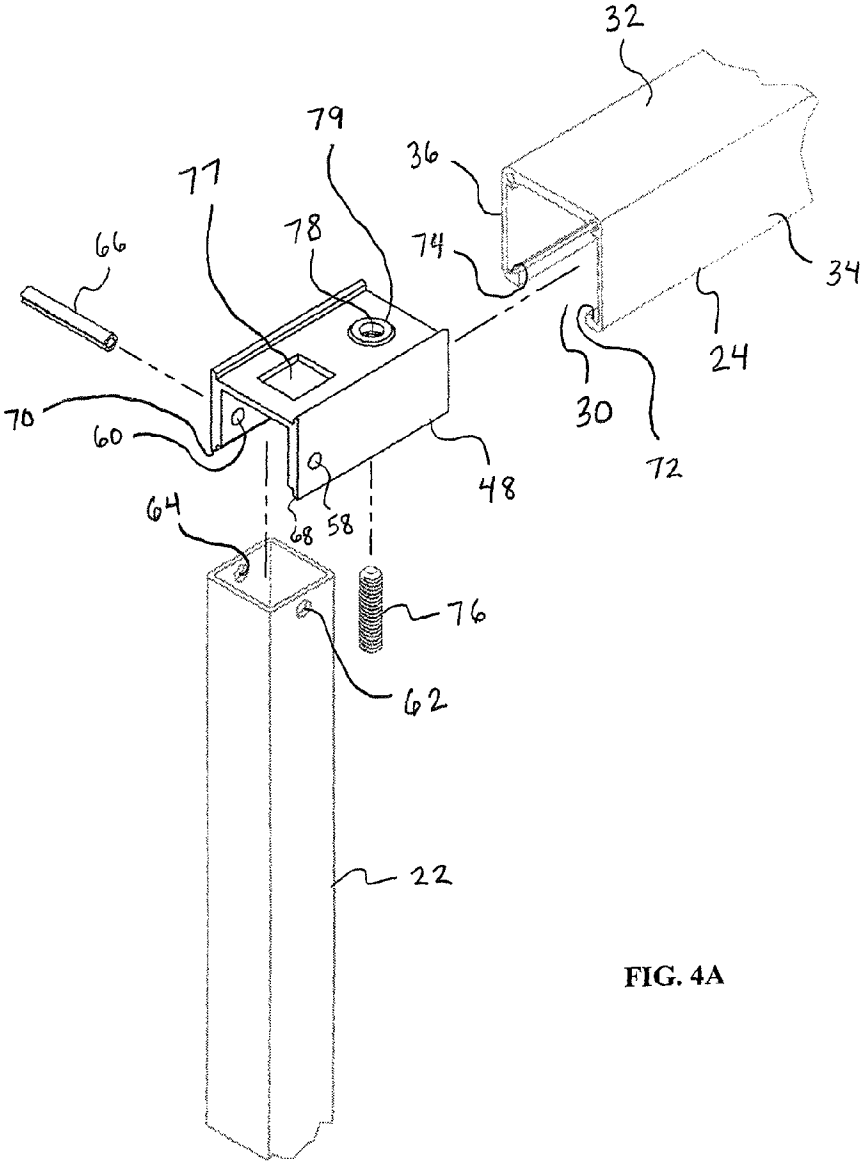
FIG. 4A is a side perspective view of an assembly drawing for a baluster being operatively coupled to a handrail section via a slide member in accordance with certain embodiments of the invention.
Figure 4C:
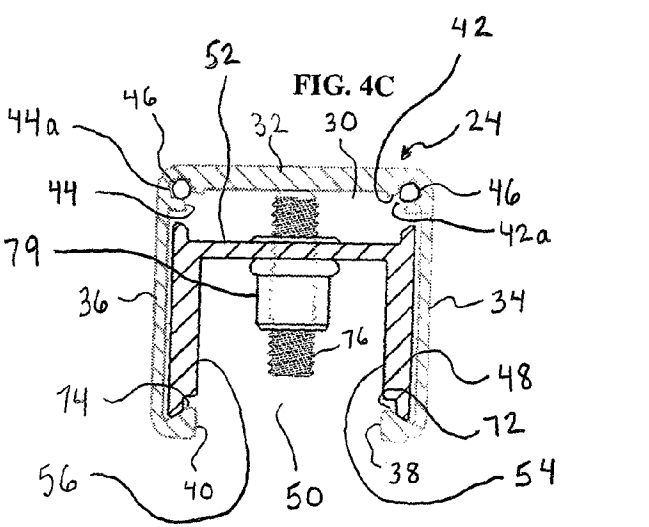
FIGS. 4C and 4D are cross-sectional views of the assembled elements of FIG. 4B that are taken along the lines and in the directions of the arrows 4C-4C and 4D-4D, respectively, of FIG. 4B.
Figure 4D:
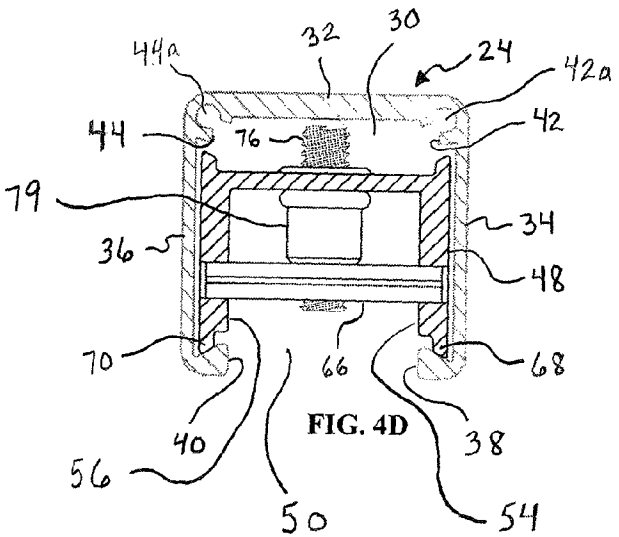
Figure 4B:
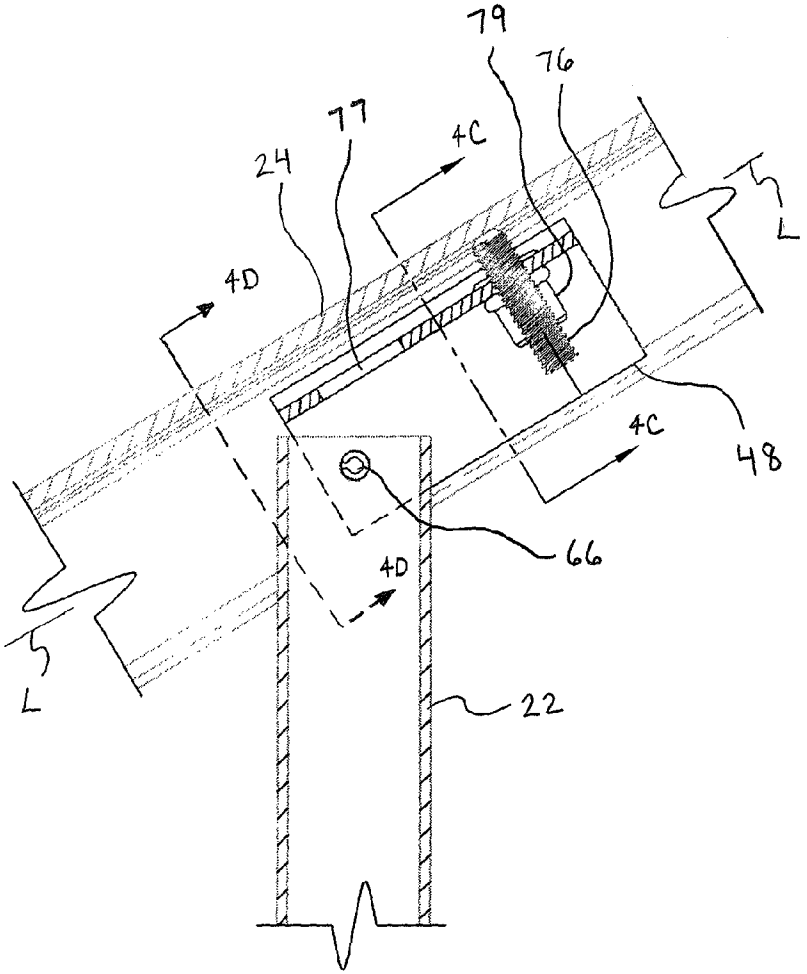
FIG. 4B is a side cross-sectional view of the assembly of the baluster, slide member, and handrail of FIG. 4A in accordance with certain embodiments of the invention.

FIG. 4A illustrates a side perspective view of an assembly drawing for operatively coupling one of the balusters 22 to the handrail section 24 in accordance with certain embodiments of the invention. FIG. 4B shows a side cross-sectional view of the assembly of the elements of FIG. 4A in certain embodiments of the invention. FIGS. 4C and 4D illustrate cross-sectional views of the assembled elements of FIG. B that are taken along the lines and in the directions of the arrows 4C-4C and 4D-4D, respectively, of FIG. 4B. With reference to FIGS. 4C and 4D, the handrail section 24 is generally U-shaped in transverse cross section and when used, is generally oriented to provide a downward facing channel 30 extending the length of the section 24. In certain embodiments, the handrail section 24, in its non-assembled condition, has its central axis of elongation along the lines L-L along its length and has little to no angular variation along such axis. The rail section 24 includes a top web 32 with a pair of side walls 34 and 36 extending substantially perpendicular from the top web's outer edges, thereby forming the channel 30. As shown, the side walls 34 and 36, at their lower ends, each includes a corresponding flange 38 and 40, respectively. The flanges 38, 40 are joined to the side walls 34, 36, respectively, to extend transversely inwardly toward each other and are spaced transversely to limit the opening to the handrail section's channel 30.

With further reference to the handrail section 24, joined to each of its upper corner portions and adjacent juncture of the side walls 34, 36 and the web 32 are respective flange pairs 42, 44. The flange pairs 42, 44 define respective channels 42*a*, 44*a* there between, each of which extends the length of the rail section 24. The channels 42*a*, 44*a* are configured to seat pins 46 therein to align multiple rail sections 24, as further described below. Such pins 46, once seated in the channels 42*a*, 44*a* would also function to increase the structural integrity of the aligned handrail sections 24.

Used in part to secure the upper end of the baluster 22 to the handrail section is a slide member 48. Like the handrail section 24, the slide member 48 is generally U-shaped in transverse cross section, and when in use, is generally oriented to provide a downward facing channel 50. The slide member 48 includes a top web 52 with a pair of parallel side walls 54 and 56 extending substantially perpendicular from the web corners, thereby defining the channel 50. The longitudinal length of the slide member 48 is greater than its transverse dimension and, in certain embodiments, is less than twice than the corresponding length dimension of the baluster 22.

As can be appreciated from FIG. 4B, in certain embodiments, the slide member 48 is pivotally coupled to the upper end of the baluster 22. As shown from FIG. 4A, the slide member 48 is placed over the upper end of the baluster 22 so as to align their respective pairs of holes 58, 60 and 62, 64. With the pairs of holes 58, 60 and 62, 64 so aligned, a pin 66 can be passed in the hole pairs so as to extend through each, as shown in FIG. 4D. As a result, the slide member 48, via the pin 66, can be pivoted relative to the baluster 22, as shown in FIG. 4B.

Following coupling of the slide member 48 with the upper end of the baluster 22, the slide member 48 is inserted within the channel 30 of the handrail section 24. Once the slide member 48 is inserted (and as shown, entirely situated) within the rail section 24, the side walls of the rail section 24 serve to not only conceal the pin 66, but also prevent the pin 66 from transversely moving out of the respective slide member holes 58 and 60. Further, the side walls 54, 56 of the slide member 48 are configured to respectively adjoin with the side walls 34, 36 of the rail section 24. As shown in FIGS. 4C and 4D, in certain embodiments, such adjoining occurs through mating of the ends of the slide member side walls 54, 56 and the flanges 38, 40 of the handrail section 24, respectively. In certain embodiments, as shown, the ends of the slide member side walls 54, 56 define narrowed portions 68, 70, respectively, that seat in corresponding grooves 72, 74 defined by the flanges 38, 40, respectively. While the ends of the slide member side walls 54, 56 and the flanges 38, 40 of the handrail section 24 are mated, the slide member 48 can still be slidably adjusted within the channel 30 of the rail section 24.

With reference to FIG. 4B, upon sliding the slide member 48 within the channel 30 so as to properly position its coupled baluster 22 relative to corresponding treads 20 of the spiral staircase 10, a threaded fastener 76, such as a bolt, is threaded through an aperture 78 in the slide member 48 to lock it in place within the channel 30. As further illustrated, in certain embodiments, the aperture 78 is defined in the top web 52 of the slide member 48 in order for the fastener 76, once extended there through, to contact a corresponding inner surface of the handrail section 24 overlaying the top web 52. In certain embodiments, as shown, the aperture 78 supports a threaded coupling 79 through which the fastener 76 is extended; however, it should be understood that there are a variety of other ways to provide a threaded entry at the aperture 78 short of requiring said coupling 79. It should be appreciated that once the slide member 48 is so secured to the handrail section 24, the baluster 22 coupled to the slide member 48 can be used as a lever to move, and thereby shape the handrail section 24 according to the curvature of the treads 20 of the spiral staircase 10, as will be further described. After shaping the handrail section 24 in such manner, the lower end of the baluster 24 can be mounted to its corresponding tread (s) 20, as described above.

Figure 5B:
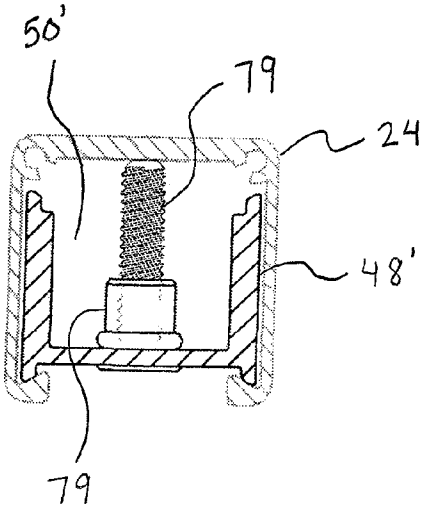
FIG. 5B is a cross-sectional view of the assembled elements of FIG. 5A that is taken along the line and in the direction of the arrows 5B-5B of FIG. 5A.
Figure 5A:
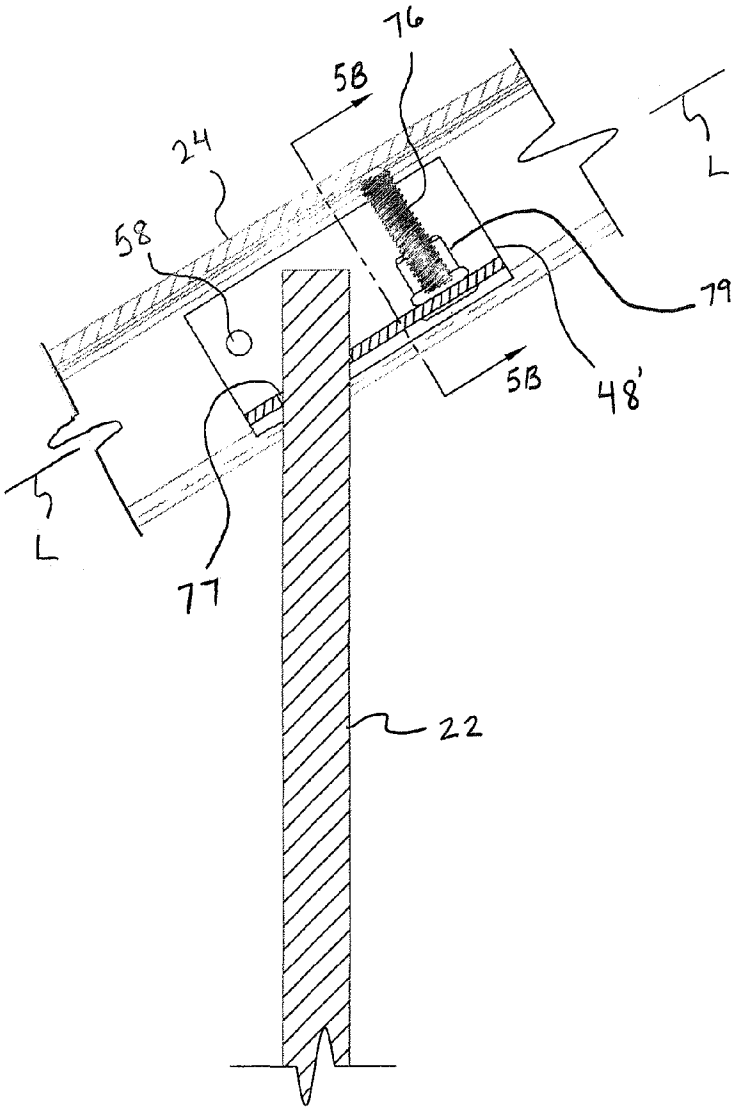
FIG. 5A is a side cross-sectional view of an alternate assembly of a baluster being operatively coupled to a handrail section via a slide member in accordance with certain embodiments of the invention.

FIG. 5A shows a side cross-sectional view of the baluster 22 being operatively coupled to the handrail section 24 via an alternate slide member 48' in accordance with certain embodiments of the invention. FIG. 5B illustrates a cross-sectional view of the assembled elements of FIG. 5A that is taken along the line and in the direction of the arrows 5B-5B of FIG. 5A. As shown, one distinction between the assemblies of FIG. 4B and FIG. 5A are the use of an alternate slide member 48', which has its channel 50' directed up toward the channel 30 of the handrail section 24. Such a configuration can have many benefits as it confines the hardware (e.g., the threaded fastener 76) within the channel 50' for aesthetic purposes (which it should be noted also occurs with the assembly of FIG. 4B but to a lesser extent) and closing the channel 50' from contaminants. Another distinction is the use of a bore 77 in securing the baluster 22 thereto without further hardware. Benefits would involve enhanced ease of attachment between the baluster 22 and the slide member 48 as well as allowing for significant tolerance for a "mid-baluster" height, i.e., the height portion of the baluster 22 not needed can extend into the channel 50'. This is important because such mid-baluster lengths often vary based on the adjusted rise of each tread 20. For example, in the case of using more than one "mid-balusters", the restraint on height is always more so as you come to the next successive mid-balusters. Accordingly, mid-balusters can be more fully utilized with such assembly without requiring the installer to re-cut the mid-balusters.

Regarding construction of the spiral staircase 10, the process is as follows. The central column 12 is installed and is configured with a plurality of collars 16 offset by spacer rings 18. As described above, the treads 20 are mounted on the collars 16 and are generally situated in vertical relationship such as exemplified with respect to FIG. 1. A first (lowermost) baluster 22 is subsequently installed, initially by being secured to the lowermost (first) tread by the fastener(s) 26 extended through one of the slots 28*a* or 28*b* in the lower portion of the baluster 22. A first slide member 48 is connected to the upper end of the first baluster 22 via the pin 66, and a first rail section 24 is then moved in a general longitudinal direction so as to have the first slide member 48 extend into the channel 30 of the handrail section 24 and slide there through its extent until the first slide member 48 reaches its desired position adjacent the descending end of the rail section 24. In turn, the threaded fastener 76 is tightened to abut against the inner surface of the rail section 24 to retain the first slide member 24 in fixed position relative to the first rail section 24.

Additional slider members 48 are pivotally attached to corresponding balusters 22 and one or more of such additional slider members 48 (with balusters 22 connected thereto) are inserted into the first rail section channel 30. In certain embodiments, the additional slide members 48 may be moved along the rail section 24 until they are approximately at the desired longitudinal spacing from one another. In turn, in certain embodiments, the threaded fastener 76 for at least the second slide member 48 is tightened to retain such slide member 48 at its desired longitudinal position relative to the rail section 24. In other embodiments, the threaded fasteners 76 for each of the additional slide members 48 may be also tightened to retain the slide members 48 at each of their desired longitudinal positions in the rail section channel 30.

With the second slide member 48 secured in desired channel position of the rail section 24, the rail section 24 is pivoted so as to shape a corresponding segment of the rail section 24. Regarding such corresponding rail section segment, its length would extend from the pivot axis at the pin 66 of the previously-secured first baluster 22 (or point of entry in the aperture 77 if using the slide member 48') up to the secured second slide member 48. In shaping the rail section segment, the baluster 22 (the second baluster) is used as a lever to twist the segment of the rail section 24 by manually moving the lower end of the lever generally about the longitudinal axis L-L of the rail section 24 toward the central column 12. Such twisting creates a force applied to the respective flanges 38, 40 of the rail section proximate to the second slide member 48 and its corresponding threaded fastener 76 (against rail section 24) such that the pivot and pin 66 of the second slide member 48 is moved to extend generally horizontally and radially toward the vertical central axis of the column 12 and the baluster 22 is moved into abutting relationship to the walls of the second and third lowermost treads 20. That is, the lowest baluster 22 (not yet secured to its corresponding treads 20) can be manually moved to twist the rail section 24 and then vertically adjusted (if necessary) relative to the lowermost (first) and the next to the lowermost (second) tread 20 to the desired vertically adjusted position and if necessary, the next to the lowermost tread 20 angularly adjusted.

In turn, the fastener(s) 26 are tightened to retain second baluster 22 extending vertically (substantial at 90 degrees to the horizontal) in the vertical adjusted position relative to the treads 20 and, if necessary, the threaded fastener 76 is loosened and the slide member 48 (second) longitudinally readjusted and then the fastener 76 re-tightened to retain the slide member 48 (second) in the desired position relative to the rail section 24. Thus, by having the elongated slots 28*a*, 28*b* in the lower portion of the second baluster 22, the second baluster 22 can be vertically adjusted and secured in a fixed position relative to the second and third treads 20 such that the segment of the rail section 24 between the first and second balusters 22 is retained at the preselected angle of inclination and elevation position for that part of the installed handrail section 24. It is noted that prior to the fasteners 26 being tightened, the next to lowermost tread is rotated about the central column to a final rotated position, if not already in such a position, the fasteners 26 being loosened and tightened to retain the second lowermost tread 20 in a fixed position relative to the central column 12.

Thereafter the next to lowermost baluster (third baluster) 22 is moved and twisted to bend the rail section 24 and the necessary above mentioned steps are taken whereby this baluster 22 can be and is connected to the walls of the second and third lowermost (second and third treads) treads 20 and the fastener 76 manipulated to secure the slide member 48 and the adjacent part of rail section 24 to the third lowest baluster 22 in the vertical broken line position of FIG. 1. These steps are repeated until all the balusters 22 for the lowermost rail section 24 are installed.

After a first (lowermost) rail section 24 is installed, in certain embodiments, a slide member 48 is extended into the lower end portion of a second rail section 24 and the threaded fastener 76 tightened therein to retain the slide member 48 in a position extending outwardly of second rail section 24. The connector pins 46 are extended into channels 42*a*, 44*a* of the second rail section 24 to extend outwardly thereof. The pins 46 are of a diameter to form a tight friction fit with the rail section 24. Now the second rail section 24, with or without slider members 48 having balusters 22 pivotally connected thereto, is moved to have the slide member 48 and pins 46 extend into the channel 30 and channels 42*a*, 44*a*, respectively, until the adjacent transverse edges of first and second rail sections 24 are in abutting relationship. As a result, the slide members 48 with balusters 22 for the second rail section 24 can be moved thereinto (if not already therein) and the lower balusters 22 for the second rail section 24 is moved lengthwise, twisted and secured to the adjacent pair of treads 20 in a manner previously indicated.

Additional rail sections 24, balusters 22 and slide members 48 are interconnected to one another and the treads 20 to complete the installation of the spiral stairway 10. To be noted is that one slide member 48 with its associated baluster 22 connected thereto may be inserted into the rail section channel 30 and slid along the rail section 24 until located in the desired position relative to the rail section 24, and thence the baluster lower end is fixedly attached to respective tread(s) 20 and fixed to the second rail section 24 in a manner above indicated, and thence the next slide member 48 with its attached baluster 22 moved into and along the second rail section 24 for being fixed to the respective treads 20 and fixed to the rail section 24 in spaced relationship to the baluster 22 initially described as mounted.

Even though the installation has been described with reference to the lowermost baluster 22 being installed first, it is to be understood the installation can initially start with first installing an uppermost baluster 22. Further, using the system of the present invention, it is also quite easy to start at a middle tread and work one's way in either direction.

In certain other embodiments, instead of first inserting the slide member 48 with the first baluster 22 pivotally connected thereto, the first baluster 22 may be secured to the lowermost tread 20, then a slide member 48 is pivotally connected thereto and thereafter moved within the lowermost rail section 24 to have one of its terminal end portions adjacent to the slide member 48 and thence into the rail section channel 30 until said end is the preselected longitudinal distance from the slide member 48. Thereafter, additional slider members 48 with balusters 22 pivotally connected thereto are inserted into the rail section 24, if not inserted prior to the installation of the first baluster 22, and the second slide member 48 (one adjacent to the first slide member 48) is longitudinal adjusted and secured in a fixed position relative to the rail section 24. The second baluster 22 is twisted and secured to the first and second treads 20 in the manner described above.

It will be appreciated the embodiments of the present invention can take many forms. The true essence and spirit of these embodiments of the invention are defined in the appended claims, and it is not intended the embodiment of the invention presented herein should limit the scope thereof.

What is claimed is:

1. A modular spiral staircase system which can be used to meet varying structural requirements for different applications, comprising:

(a) a central column;

(b) a plurality of treads extending radially outward from the central column, the plurality of treads being vertically and angularly offset from each other over a height of the central column;

(c) a handrail comprising one or more sections, the one or more sections forming a continuous channel, the channel defined by two side walls extending over the longitudinal extent of the handrail;

(d) a plurality of slide members, each of the slide members forming a channel, the channel defined by two side walls extending over the longitudinal extent of the slide member, each slide member sized to fit within the handrail channel; and (e) a plurality of balusters, each of the plurality of balusters being operatively coupled at an upper end thereof with a corresponding one of the plurality of the slide members such that each of the plurality of balusters is vertically positionable along the extent of one of the plurality of handrail sections via selective sliding of the corresponding slide member within the handrail channel, each of the plurality of slide members secured to the handrail with a fastener, wherein each fastener is entirely situated within the handrail channel.

2. The modular spiral staircase system of claim 1 wherein each of the one or more sections of the handrail when in its non-assembled condition have little to no angular variation along its central axis.

3. The modular spiral staircase system of claim 1 wherein each baluster is pivotally coupled to the corresponding slide member via a pin.

4. The modular spiral staircase system of claim 3, wherein the pin extends through aligned pairs of holes of each baluster and the corresponding slide member.

5. The modular spiral staircase system of claim 1 wherein the upper end of each baluster is positioned within an aperture of the corresponding slide member.

6. The modular spiral staircase system of claim 1 wherein following each one of the plurality of balusters being is operatively secured to the handrail section, the one baluster serves as a lever for shaping the one handrail section along the vertically and angularly offset plurality of treads.

7. The modular spiral staircase system of claim 1 wherein the side walls of each slide member extend in a parallel direction with the side walls of the handrail.

8. The modular spiral staircase system of claim 1 wherein the handrail comprises at least two sections, and further comprises two pins extending through corresponding channels of the at least two handrail sections, the pins connecting and aligning the at least two handrail sections together.

9. A modular spiral staircase system which can be used to meet varying structural requirements for different applications, comprising:

(a) a central column;

(b) a plurality of treads extending radially outward from the central column, the plurality of treads being vertically and angularly offset from each other over a height of the central column;

(c) a handrail comprising one or more sections, the one or more sections forming a continuous channel, the channel defined by two side walls extending over the longitudinal extent of the handrail;

(d) a plurality of slide members, each of the slide members forming a channel, the channel defined by two side walls extending over the longitudinal extent of the slide member, each slide member sized to fit within the handrail channel; and (e) a plurality of balusters, each of the plurality of balusters being operatively coupled at an upper end thereof with a corresponding one of the plurality of the slide members such that each of the plurality of balusters is vertically positionable along the extent of one of the plurality of handrail sections via selective sliding of the corresponding slide member within the handrail channel, each slide member operatively secured to the handrail and the upper end of each baluster joined to each corresponding slide member via a pin, wherein the pin is entirely situated within the channel of the handrail.

10. The modular spiral staircase system of claim 9 wherein each baluster is pivotally coupled to the corresponding slide member via the pin.

11. The modular spiral staircase system of claim 10, wherein the pin extends through aligned pairs of holes of each baluster and the corresponding slide member.

12. The modular spiral staircase system of claim 9 wherein the side walls of each the slide member extend in a parallel direction with the side walls of the handrail.

13. The modular spiral staircase system of claim 9 wherein each of the plurality of balusters has a plurality of vertical slots defined therein for vertical adjustment of the balusters with corresponding of the plurality of treads.

14. The modular spiral staircase system of claim 9 wherein the handrail comprises at least two sections, and further comprising two pins extending through corresponding channels of the at least two handrail sections, the pins connecting and aligning the at least two handrail sections together.

15. The modular spiral staircase system of claim 9 wherein the two side walls of the handrail channel each has a flange at its lower end and extends over the longitudinal extent of the handrail, wherein each flange forms a groove.

16. The modular spiral staircase system of claim 15 wherein the two side walls of each slide member each has a narrowed portion at its lower end and extends over the longitudinal extent of the slide member, wherein the narrowed portions of the slide member walls are seated in the grooves of the handrail walls.

17. The modular spiral staircase system of claim 1 wherein each slide member is entirely situated within the channel of the handrail.

18. The modular spiral staircase of claim 9 wherein each slide member is entirely situated within the channel of the handrail.

19. The modular spiral staircase of claim 1 wherein each baluster is joined to each corresponding slide member via a pin, wherein the pin is entirely situated within the channel of the handrail.

20. The modular spiral staircase of claim 1 wherein the two side walls each has a flange at its lower end and extends over the longitudinal extent of the handrail, wherein each flange forms a groove.

21. The modular spiral staircase of claim 20, wherein the two side walls of the slide member each has a narrowed portion at its lower end and extends over the longitudinal extent of the slide member, wherein the narrowed portions of the slide member walls are seated in the grooves of the handrail walls.

22. The modular spiral staircase of claim 21 wherein the one slide member is operatively secured to the one handrail section and the corresponding baluster is operatively coupled with one or more of the treads when the one baluster is at a desired position with the one or more treads.

* * * * *